US009922598B2

(12) United States Patent
Park et al.

(10) Patent No.: US 9,922,598 B2
(45) Date of Patent: Mar. 20, 2018

(54) ORGANIC LIGHT EMITTING DIODE DISPLAY AND METHOD FOR SENSING CHARACTERISTIC THEREOF

(71) Applicant: LG Display Co., Ltd., Seoul (KR)

(72) Inventors: Dongwon Park, Goyang-si (KR); Heejung Hong, Seoul (KR)

(73) Assignee: LG Display Co., Ltd., Seoul (KR)

( * ) Notice: Subject to any disclaimer, the term of this patent is extended or adjusted under 35 U.S.C. 154(b) by 140 days.

(21) Appl. No.: 14/965,653

(22) Filed: Dec. 10, 2015

(65) Prior Publication Data

US 2016/0189618 A1 Jun. 30, 2016

(30) Foreign Application Priority Data

Dec. 24, 2014 (KR) ..... 10-2014-0188873

(51) Int. Cl.
*G09G 3/3258* (2016.01)
*G09G 3/3233* (2016.01)
(Continued)

(52) U.S. Cl.
CPC ..... *G09G 3/3258* (2013.01); *G09G 3/3233* (2013.01); *G09G 3/3266* (2013.01); *G09G 3/3275* (2013.01); *G09G 2300/043* (2013.01); *G09G 2310/0278* (2013.01); *G09G 2310/08* (2013.01); *G09G 2320/02* (2013.01); *G09G 2320/029* (2013.01);
(Continued)

(58) Field of Classification Search
CPC ..... G09G 2320/043; G09G 2320/048
See application file for complete search history.

(56) References Cited

U.S. PATENT DOCUMENTS

2006/0158402 A1* 7/2006 Nathan ..... G09G 3/3233 345/82
2011/0037774 A1* 2/2011 Chen ..... G09G 3/006 345/589
(Continued)

FOREIGN PATENT DOCUMENTS

CN 101116129 A 1/2008
CN 101334978 A 12/2008
(Continued)

OTHER PUBLICATIONS

European Partial Search Report, European Application No. 15200323.2, dated Apr. 4, 2016, 6 pages.
(Continued)

*Primary Examiner* — Christopher Kohlman
(74) *Attorney, Agent, or Firm* — Fenwick & West LLP

(57) ABSTRACT

Embodiments relate to selectively sensing device characteristics of pixels in a sensing period. Input image displayed on a display panel is analyzed to determine the complexity or gray level difference in different portions of the input image. Based on analysis, the portions of the display panel likely to result in significantly difference in device characteristics are selected with smaller intervals but portions of the display panel likely to experience the same or similar device characteristics are selected with larger intervals. The device characteristics of only the selected pixels are sensed in a sensing period while the remaining pixels are estimated based on the sensed device characteristics.

21 Claims, 12 Drawing Sheets

(51) Int. Cl.
*G09G 3/3266* (2016.01)
*G09G 3/3275* (2016.01)

(52) U.S. Cl.
CPC ..... *G09G 2320/0233* (2013.01); *G09G 2320/0285* (2013.01); *G09G 2320/0295* (2013.01); *G09G 2320/043* (2013.01); *G09G 2320/045* (2013.01); *G09G 2320/103* (2013.01); *G09G 2330/021* (2013.01); *G09G 2360/145* (2013.01)

(56) References Cited

U.S. PATENT DOCUMENTS

2011/0051007 A1* 3/2011 Hosaka ..... G09G 3/2003 348/673
2013/0314457 A1* 11/2013 Yasui ..... G09G 3/36 345/691

FOREIGN PATENT DOCUMENTS

| | | | |
|---|---|---|---|
| CN | 102005192 | A | 4/2011 |
| CN | 102368374 | A | 3/2012 |
| EP | 0837444 | A3 | 6/1998 |
| JP | 2004-318744 | A | 11/2004 |
| KR | 10-2008-0039160 | A | 5/2008 |
| WO | WO 2006/063448 | A1 | 6/2006 |
| WO | WO 2014140522 | A2 | 9/2014 |

OTHER PUBLICATIONS

European Extended Search Report, European Application No. 15200323.2, dated Jul. 5, 2016, 13 pages.
Chinese First Office Action, Chinese Application No. 201510556560.X, dated Oct. 16, 2017, 21 pages.

* cited by examiner

ORGANIC LIGHT EMITTING DIODE DISPLAY AND METHOD FOR SENSING CHARACTERISTIC THEREOF

CROSS-REFERENCE TO RELATED APPLICATION

This application claims the benefit of Korean Patent Application No. 10-2014-0188873 filed on Dec. 24, 2014, the entire contents of which is incorporated herein by reference for all purposes as if fully set forth herein.

BACKGROUND OF THE INVENTION

Field of the Invention

Embodiments of the invention relate to an organic light emitting diode (OLED) display and a method for sensing device characteristics of the OLED display.

Discussion of the Related Art

An organic light emitting diode (OLED) display is a self-emission display device. The OLED display may be manufactured to have lower power consumption and a thinner profile than a liquid crystal display requiring a backlight unit. Further, the OLED display has advantages of a wide viewing angle and a fast response time. As the process technology of the OLED display has been developed to mass produce large-screens, the OLED display has expanded its market while competing with the liquid crystal display.

Each pixel of the OLED display includes an organic light emitting diode (OLED) having a self-emitting structure. The OLED display displays an input image using the OLED of the pixel that emits light when electrons and holes are combined in an organic layer through a current flowing in a fluorescence or phosphorescence organic thin film. An organic compound layer including a hole injection layer HIL, a hole transport layer HTL, an emission layer EML, an electron transport layer ETL, an electron injection layer EIL, etc. is stacked between an anode and a cathode of the OLED.

The OLED display may be variously classified depending on kinds of emission materials, an emission method, an emission structure, a driving method, and the like. For example, an OLED display may be classified into a fluorescent emission type and a phosphorescent emission type depending on the emission method. Further, the OLED display may be classified into a top emission type and a bottom emission type depending on the emission structure. Further, the OLED display may be classified into a passive matrix OLED (PMOLED) display and an active matrix OLED (AMOLED) display depending on the driving method.

Each pixel of the OLED display includes a driving thin film transistor (TFT) controlling a driving current flowing in the OLED depending on data of the input image. Device characteristics of the driving TFT (e.g., a threshold voltage and a mobility of the driving TFT) may change depending on a process deviation, a driving time, a driving environment, etc. The pixels of the OLED display are degraded due to changes in the device characteristics of the driving TFTs. The degradation of the pixels leads to an inferior image quality and decreased lifespan of the OLED display. Thus, technology for sensing changes in the device characteristics of the pixels and modify input data to the pixels based on the sensing result to compensate for the degradation of the pixels is used in the OLED display. The changes in the device characteristics of the pixels include changes in the characteristics of the driving TFT including the threshold voltage, the mobility, etc. of the driving TFT.

Because a related art compensation technology periodically senses changes in device characteristics of all of pixels so as to decide changes in device characteristics of each pixel, it takes a long time for the related art compensation technology to sense changes in the device characteristics of the pixels. Further, the related art compensation technology requires a mass memory capable of storing sensing data of all of the pixels.

SUMMARY OF THE INVENTION

Embodiments of the invention relate to sensing device characteristics of pixels. An input image is analyzed to at least determine gray level difference in a first direction at different portions of the input image. The different portions include a first portion with a first level of gray level difference in the first direction and a second portion with a second level of gray level difference in the first direction. The second level of gray level difference is higher than the first level of gray level difference. A subset of pixels in a display panel is selected based on the analysis of the input image. The selected subset of pixels displaying the first portion is separated in the first direction by a first sensing interval. The selected subset of pixels displaying the second portion is separated in the first direction by a second interval shorter than the first interval. The device characteristics of the selected subset of pixels are sensed in a first sensing period. The device characteristics of unselected pixels are estimated based on the sensed device characteristics of the pixels.

In one embodiment, gray level difference in a second direction perpendicular to the first direction is further analyzed. The different portions further include a third portion with a third level of gray level difference in the second direction and a fourth portion with a fourth level of gray level difference in the second direction. The fourth level of gray level difference is higher than the third level of gray level difference. The selected subset of pixels displaying the third portion is separated in the second direction by a third sensing interval, and the selected subset of pixels displaying the fourth portion is separated in the second direction by a fourth interval shorter than the third interval.

In one embodiment, another subset of pixels in the display panel different from the subset of pixels is selected in a second sensing period subsequent to the first sensing period. The device characteristics of the other selected subset of pixels in the second sensing period are sensed. The device characteristics of the other selected subset of pixels in the second sensing period are estimated.

In one embodiment, a first temporal interval between the first sensing period and the second sensing period for the input image that is stationary is longer than a second temporal interval between the first sending period and the second sensing period for the input image that is dynamic.

In one embodiment, the other subset of pixels of the first portion selected in the second sensing period includes pixels displaying the first portion but different from the pixels selected in the first sensing period.

In one embodiment, the input image is divided into the different portions where each of the portions is of the same size.

In one embodiment, the device characteristics include at least one of a threshold voltage of a thin film transistor (TFT) for driving an organic light emitting diode (OLED) in a pixel or mobility of the TFT for driving the OLED in the pixel.

In one embodiment, the device characteristics comprises are estimated by performing interpolation on the selected subset of pixels in the first portion to estimate the device characteristics of unselected pixels in the first portion, and performing interpolation on the selected subset of pixels in the second portion to estimate the device characteristics of unselected pixels in the second portion.

In one embodiment, the sensed device characteristics of the pixels and the estimated device characteristics of the pixels are stored to perform data compensation to account for degradation of the pixels.

Embodiments also relate to a display panel driving circuit in a display device including an image analyzer and a data driver circuit. The image analyzer includes a processor and a non-transitory computer-readable storage medium. The computer-readable storage medium stores instructions that cause a processor to analyze an input image to at least determine gray level difference in a first direction at different portions of the input image. The different portions including a first portion with a first level of gray level difference in the first direction and a second portion with a second level of gray level difference in the first direction. The second level of gray level difference is higher than the first level of gray level difference. A subset of pixels in a display panel is selected based on the analysis of the input image. The selected subset of pixels displaying the first portion is separated in the first direction by a first sensing interval. The selected subset of pixels displaying the second portion is separated in the first direction by a second interval shorter than the first interval. The data driver circuit senses the device characteristics of the selected subset of pixels in a first sensing period, and estimates the device characteristics of unselected pixels based on the sensed device characteristics of the pixels.

Embodiments also relate to a display device including a display panel, an image analyzer, and a data driver circuit. The display panel includes a plurality of pixels with organic light emitting diodes (OLEDs). The image analyzer includes a processor and a non-transitory computer-readable storage medium storing instructions. When the instructions are executed, the processor analyzes an input image to at least determine gray level difference in a direction at different portions of the input image. The different portions including a first portion with a first level of gray level difference in the first direction and a second portion with a second level of gray level difference in the same direction. The second level of gray level difference is higher than the first level of gray level difference. A subset of pixels in a display panel is selected based on the analysis of the input image. The selected subset of pixels displaying the first portion is separated in the first direction by a first sensing interval. The selected subset of pixels displaying the second portion is separated in the first direction by a second interval shorter than the first interval. The data driver circuit senses the device characteristics of the selected subset of pixels in a sensing period and estimates the device characteristics of unselected pixels based on the sensed device characteristics of the pixels.

Embodiments also relate to a non-transitory computer-readable storage medium storing instructions. The processor executes the instructions to analyze an input image to at least determine gray level difference in a direction at different portions of the input image. The different portions including a first portion with a first level of gray level difference in the direction and a second portion with a second level of gray level difference in the same direction. The second level of gray level difference is higher than the first level of gray level difference. A subset of pixels in a display panel is selected based on the analysis of the input image. The selected subset of pixels displaying the first portion is separated in the first direction by a first sensing interval. The selected subset of pixels displaying the second portion is separated in the first direction by a second interval shorter than the first interval. The device characteristics of the selected subset of pixels are sensed in a sensing period but the device characteristics of unselected pixels are estimated based on the sensed device characteristics of the pixels.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention. In the drawings.

DETAILED DESCRIPTION OF THE EMBODIMENTS

Reference will now be made in detail to embodiments of the invention, examples of which are illustrated in the accompanying drawings. Wherever possible, the same reference numbers will be used throughout the drawings to refer to the same or like parts. It will be paid attention that detailed description of known arts will be omitted if it is determined that the arts can mislead the embodiments of the invention.

Figure 1:
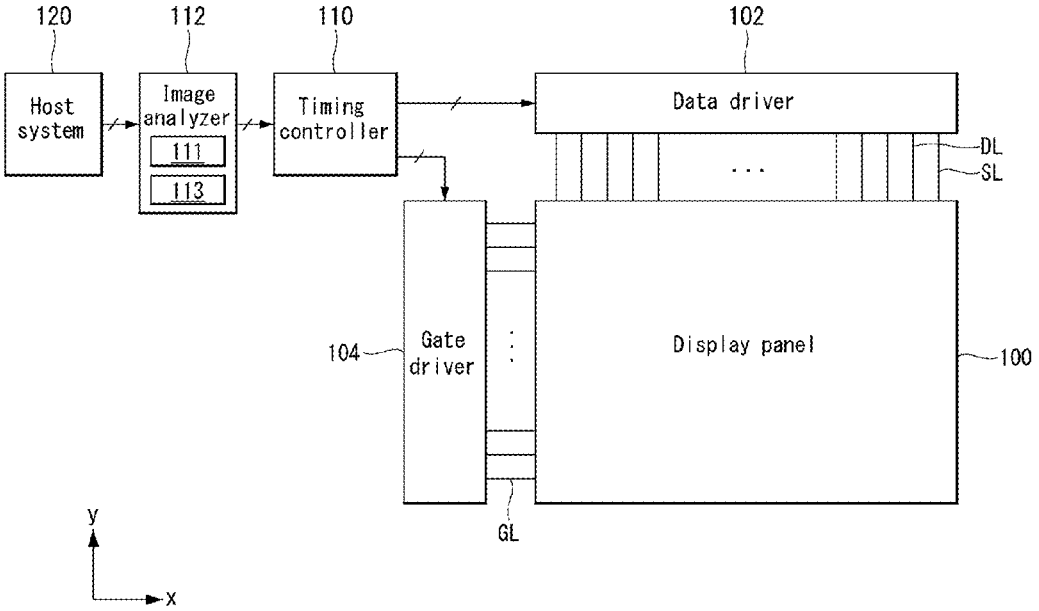
FIG. 1 is a block diagram of an organic light emitting diode (OLED) display according to one embodiment.
Figure 2:
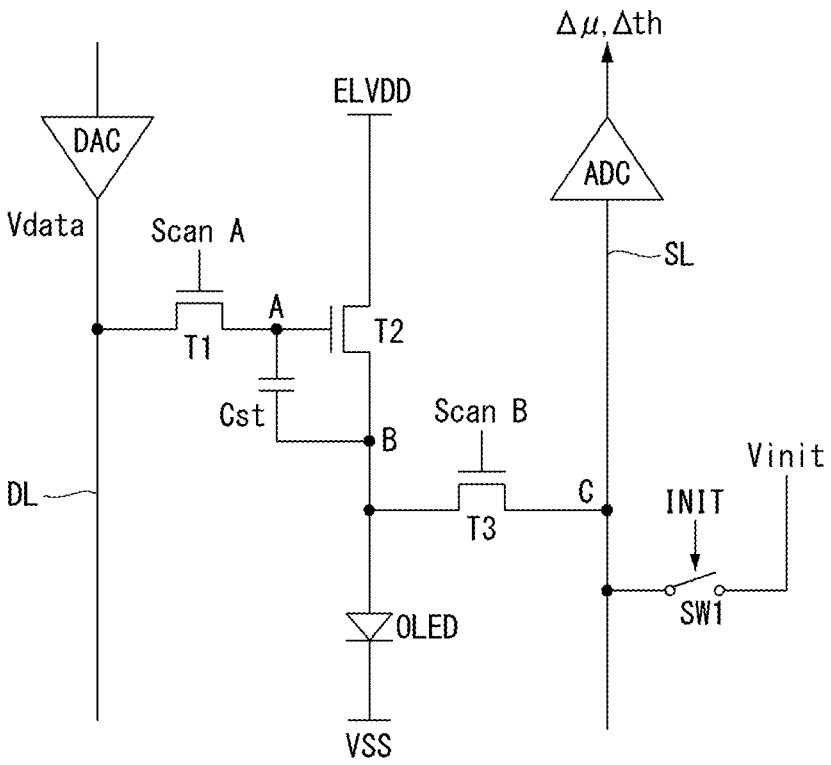
FIG. 2 is an equivalent circuit diagram of a pixel in an OLED display according to one embodiment.
Figure 3:
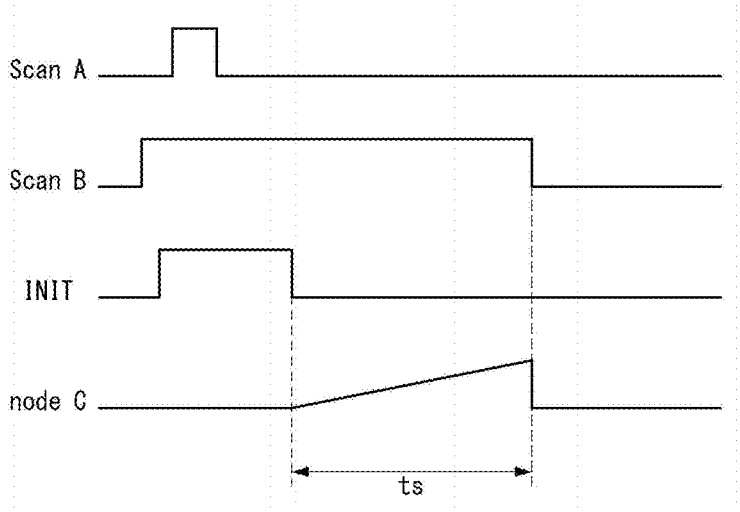
FIG. 3 is a timing diagram showing signals for sensing changes in device characteristics of a pixel, according to one embodiment.

Referring to FIGS. 1 to 3, an organic light emitting diode (OLED) display according to an exemplary embodiment of the invention includes a display panel 100, an image analyzer 112, and a display panel driving circuit. The display panel driving circuit may include, for example, a timing controller 110, a data driver 102 and a gate driver 104.

A pixel array of the display panel 100 displays data of an input image. The pixel array of the display panel 100 includes a plurality of data lines DL, a plurality of scan (or gate) lines GL crossing the data lines DL, and pixels arranged in a matrix form. Each pixel may include a red subpixel, a green subpixel, and a blue subpixel for the color representation. Each pixel may further include a white subpixel. The display panel 100 may include a red color filter, a green color filter, and a blue color filter.

The display panel 100 includes reference lines SL for sensing changes in device characteristics of the pixels. A pair of scan lines may be connected to each subpixel, so that first and second scan signals Scan A and Scan B can be applied to each subpixel.

The change in the device characteristics of the pixel includes changes in characteristics of a driving thin film transistor (TFT), for example, the change in a threshold voltage of the driving TFT ($\Delta Vth$), the change in the mobility of the driving TFT ($\Delta\mu$), etc.

FIG. 2 is an equivalent circuit diagram of a pixel in an OLED display according to one embodiment. As shown in FIG. 2, each pixel may include three thin film transistors (TFTs) T1, T2, and T3, a storage capacitor Cst, and an organic light emitting diode (OLED), but is not limited thereto. The OLED may be configured as an organic compound layer including a hole injection layer HIL, a hole transport layer HTL, an emission layer EML, an electron transport layer ETL, an electron injection layer EIL, etc. An anode of the OLED is connected to a source of the second TFT T2, and a cathode of the OLED is connected to a ground level voltage source GND.

The first TFT T1 applies a data signal input through the data line DL to a gate of the second TFT T2 through a first node A in response to the first scan signal Scan A. A gate of the first TFT T1 is connected to a first scan line GL, to which the first scan signal Scan A is applied. A drain of the first TFT T1 is connected to the data line DL, and a source of the first TFT T1 is connected to the gate of the second TFT T2 via the first node A.

The second TFT T2 operates as a driving TFT and adjusts current flowing in the OLED depending on a gate voltage. A high potential power voltage ELVDD is applied to a drain of the second TFT T2. The source of the second TFT T2 is connected to the anode of the OLED via a second node B.

The third TFT T3 connects the second node B to a third node C in response to the second scan signal Scan B. The third node C is connected to the reference line SL. The third TFT T3 is turned on during a sensing period for sensing changes in the device characteristics of the pixel. The sensing period may be set within a vertical blank period, in which data is not written on the pixels. In this instance, the third TFT T3 maintains an off-state during a data enable period, in which data is written on the pixels, and is turned on in response to the second scan signal Scan B during the vertical blank period. A drain of the third TFT T3 is connected to the second node B, and a source of the third TFT T3 is connected to the third node C. A gate of the third TFT T3 is connected to a second scan line GL, to which the second scan signal Scan B is applied. The storage capacitor Cst is connected between the gate and the source of the second TFT T2 through the first and second nodes A and B.

The image analyzer 112 includes a processor 111 and a computer-readable storage medium 113 for storing instructions. The image analyzer 112 analyzes data of the input image received from a host system 120 and analyzes one or more of gray level distribution, complexity, and a motion of the input image in each frame period. An image analysis method may use any known method, for example, a histogram analysis method, an analysis method using an edge filter, a motion vector analysis method, etc. In general, a display device includes an image analysis module embedded in a timing controller 110 and analyzing an input image, so as to improve image quality. In this instance, the embodiment of the invention may use the image analyzer 112 as the existing image analysis module without adding a new component. The image analyzer 112 may be embedded in the timing controller 110.

The image analyzer 112 receives timing signals synchronized with the input image from the host system 120. The timing signals include a vertical sync signal Vsync, a horizontal sync signal Hsync, a data enable signal DE, a dot clock DCLK, and the like. The image analyzer 112 selects a pixel whose changes in device characteristics are to be sensed based on the analysis of the input image, as described below in detail with reference to FIG. 6, and transmits location information of the pixel to the timing controller 110. The image analyzer 112 counts the timing signals and may determine the location of the pixel whose device characteristics are to be sensed.

The image analyzer 112 divides the input image into a plurality of blocks. The image analyzer 112 may analyze the input image on a per block basis and may determine a spatial distance or temporal distance (hereinafter, referred to as "a sensing interval") between pixels to be sensed directly in each block, and the location of the pixels to be sensed based on the analysis of the image. The sensing interval and the location of the sensed pixel within each block may be changed depending on the analysis of the image. The image analyzer 112 reduces the sensing interval in an image with high complexity and increases the sensing interval in an image with low complexity. Also, the image analyzer 112 reduces the sensing interval in an image having a large gray level difference and increases the sensing interval in an image having a small gray level difference. The image analyzer 112 may change a time interval for changing a location of a pixel to be sensed based on the analysis of the image. For example, the image analyzer 112 may reduce a time interval changing the sensing location in a motion picture and may increase the time interval in a still image.

The host system 120 may be implemented as one of a television system, a set-top box, a navigation system, a DVD player, a Blu-ray player, a personal computer (PC), a home theater system, and a phone system.

The display panel driving circuit includes a data driver 102, a gate driver 104, and the timing controller 110. The display panel driving circuit writes the data of the input image on the pixel array of the display panel 100. The display panel driving circuit senses changes in the device characteristics of the pixel and modulates the data of the input image based on the changes in the device characteristics of the pixel, thereby compensating for the changes in the device characteristics of the pixel.

The display panel 100 and/or the data driver 102 include(s) a sensing unit for sensing changes in the device characteristics of the pixels. The sensing unit may include an analog-to-digital converter (ADC) connected to the pixels and at least one switching element.

The data driver 102 includes at least one source driver integrated circuit (IC). The data driver 102 converts data of the input image received from the timing controller 110 into an analog gamma compensation voltage using a digital-to-analog converter (DAC) and generates the data signal. The data driver 102 outputs the data signal to the data lines DL. Each pixel data includes red data, green data, and blue data. Each pixel data may further include white data.

The data driver 102 transmits a sensing value received through the ADC to the timing controller 110. The ADC, the DAC, and a switch SW1 shown in FIG. 2 may be embedded in the data driver 102. The sensing value is digital data representing changes in the device characteristics of the pixels being directly sensed by the sensing unit.

The gate driver 104 supplies a scan signal (or a gate pulse) synchronized with an output voltage of the data driver 102 to the scan lines GL during the data enable period under the control of the timing controller 110. The gate driver 104 supplies the scan signal for sensing changes in the device characteristics to the scan lines GL during the vertical blank period. Thus, the gate driver 104 sequentially shifts the scan signal and sequentially selects the pixels for applying data on a per line basis. Further, the gate driver 104 sequentially selects the pixels to sense their device characteristics on a per line basis.

The data driver 102 and the gate driver 104 drive all of channels during a period during which image data is applied to the pixels under the control of the timing controller 110. The timing controller 110 may selectively turn on or off driving channels of the data driver 102, the gate driver 104, and the sensing unit, so as to drive only the channels connected to the pixel of the sensing location. Hence, power consumption may be minimized during the sensing period.

The timing controller 110 receives the pixel data of the input image and the timing signals from the host system 120. The timing controller 110 generates timing control signals for controlling operation timings of the data driver 102 and the gate driver 104 based on the timing signals Vsync, Hsync, DE, and DCLK received along with the pixel data of the input image.

The timing controller 110 may execute an image quality compensation algorithm calculating a compensation value based on the sensing value received through the ADC. The image quality compensation algorithm may use any known algorithm compensating for changes in the device characteristics of the OLED display. The image quality compensation algorithm obtains the sensing values from the pixels of the sensing location, calculates changes in device characteristics of remaining pixels using the sensing values, and estimates changes in the device characteristics of the remaining pixels. The image quality compensation algorithm stores the sensing value received through the ADC in a memory (not shown), selects a compensation value previously set based on the sensing value, and modulates the data of the input image using the compensation value. The compensation value may be added to or subtracted from the data of the input image to produce an offset value compensating for the threshold voltage of the driving TFT. Further, the compensation value may be multiplied by the pixel data to produce a gain value compensating for the mobility of the driving TFT. The timing controller 110 transmits the pixel data modulated by the image quality compensation algorithm to the data driver 102. As described above, the embodiment of the invention compensates for the changes in the device characteristics of the pixels and thus can increase the lifespan of the OLED display.

FIG. 3 is a timing diagram showing signals for sensing changes in device characteristics of a pixel, according to one embodiment. The timing controller 110 generates the first and second scan signals Scan A and Scan B and an initialization pulse INIT during the vertical blank period. A pulse width of the first scan signal Scan A is shorter than a pulse width of the second scan signal Scan B. A width of the initialization pulse INIT is longer than the pulse width of the first scan signal Scan A and is shorter than pulse width of the second scan signal Scan B. After the level of the second scan signal Scan B rises, the levels of initialization pulse INIT and the first scan signal Scan A subsequently rise. After the level of the first scan signal Scan A falls, the level of the initialization pulse INIT and the second scan signal Scan B subsequently fall.

The data driver 102 supplies a previously set data signal to the data lines DL during the vertical blank period, to enable sensing of changes in the device characteristics of the pixels. In the embodiment disclosed herein, the previously set data signal is a signal set to a predetermined voltage irrespective of the data signal of the input image The third TFT T3 is turned on in response to the second scan signal Scan B and connects the second node B to the third node C. Subsequently, the initialization pulse INIT turns on the switch SW1 and supplies a predetermined initialization voltage Vinit to the third node C. The initialization voltage Vinit initializes the second node B and the third node C. Subsequently, the first scan signal Scan A is generated, and the predetermined data signal is applied to the gate of the second TFT T2. Hence, voltages of the second and third nodes B and C rise. The ADC converts changes in the voltage of the third node C rising for a sensing time is into digital and outputs a sensing value. The sensing value indicates changes in the device characteristics of the pixel and is transmitted to the timing controller 110.

Figure 4:
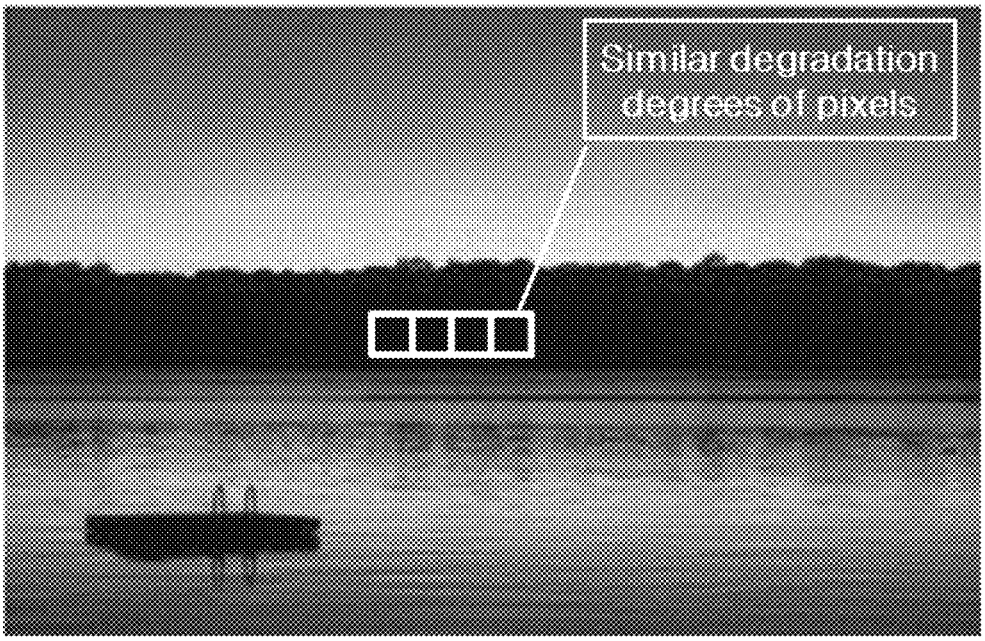
FIG. 4 is an example image with similar degrees of degradation across pixels.
Figure 5:
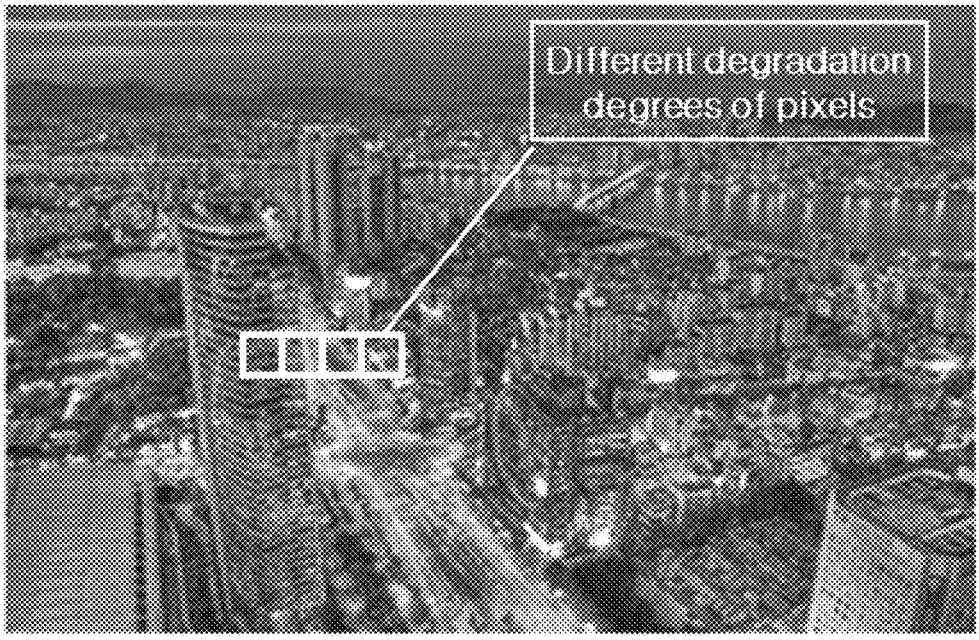
FIG. 5 is an example image with different degrees of degradation across pixels.
Figure 6:
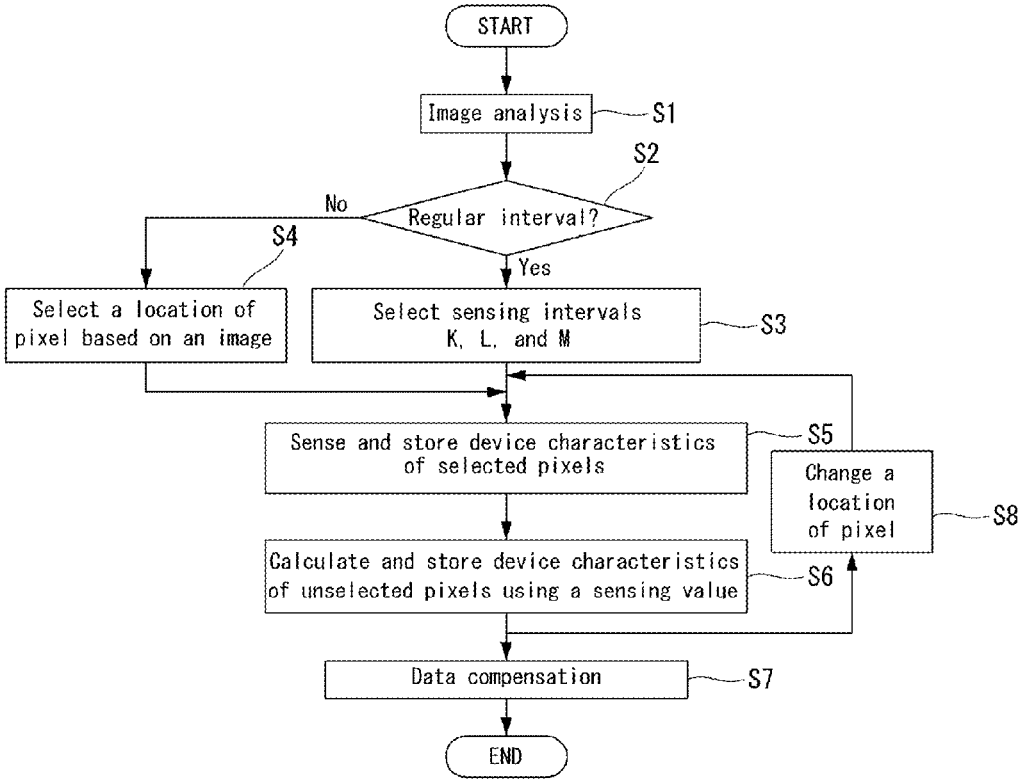
FIG. 6 is a flow chart showing a method for sensing device characteristics of a display device, according to one embodiment.

The degree of pixel degradation may be different among pixels depending on the input image. Taking example of an image shown in FIG. 4, pixels applied with the same gray level or similar gray levels are similarly degraded. On the contrary, in the example of FIG. 5, the degree of pixel degradations varies among pixels depending on gray levels applied to the pixels. Because high gray level data cause stresses in the driving TFT T2 of the pixel more than low gray level data, the pixel receiving the high gray level data may be degraded more rapidly than the pixel receiving the low gray level data. As shown in FIG. 6, the embodiment of the invention changes an interval between the pixels to be sensed and time interval for sensing based on the degree of pixel degradation that in turn depends on the input image.

FIG. 6 is a flow chart showing a method for sensing the device characteristics of the display device according to one the embodiment of the invention. The device characteristics sensing method analyzes S1 an input image and decides S2 a sensing interval based on the analysis of the input image.

A method for sensing the device characteristics according to one embodiment divides an input image into a plurality of blocks having the same size. When the degree of complexity and/or gradation of gray levels of one block in a horizontal direction (for example, x-axis direction) and a vertical direction (for example, y-axis direction) are about the same or similar, the sensing interval of one block is selected S3. The sensing interval is an interval between pixels whose device characteristics are to be sensed directly. The sensing interval includes (i) a spatial sensing interval (K, L) between pixels in one frame period and (ii) a temporal sensing interval (M) for changing the sensing locations across multiple frame periods. The spatial distance includes a sensing interval K in the horizontal direction (x-axis direction) and a sensing interval L in the vertical direction (y-axis direction).

If the pixel data indicates that there are one or more blocks having the degree of complexity and/or gray level difference exceeding a previously set threshold value, the sensing interval of the block is set S4 to an irregular interval in accordance with characteristics of the input image. The sensing intervals K, L, and M increase in a portion of the image where the degree of complexity and/or the gray level difference within the blocks remain the same or are similar. On the other hand, the sensing intervals K, L, and M decrease in a portion of the image where the degree of complexity and/or the gray level difference within the blocks exceed the predetermined threshold value. There may be more than one threshold value used for different sensing intervals K, L and M so as to variously select the sensing interval depending on the input image.

Subsequently, pixels separated by the sensing interval are selected S3 or S4. The device characteristics of the selected pixels are sensed and stored S5 in memory. Device characteristics of unselected pixels are estimated using the sensed device characteristics and projected degree of degradation in the unselected pixels and stored S6 in the memory.

Embodiments of the invention changes the location of the pixel to be sensed, senses device characteristics of the pixel, and estimates device characteristics of the remaining pixels using the device characteristics of the sensed pixel. Hence, embodiments may apply a direct sensing method and an indirect sensing method to all of the pixels. The indirect sensing method calculates changes in device characteristics of other pixels using the sensing values and estimates the degree of degradation in pixels that were not directly sensed.

Embodiments also change S8 a location of a pixel to be sensed for each frame period, at predetermined time intervals, or at variable time intervals set based on the analysis of the image analysis, so that all of the pixels in a block are directly sensed as time elapses. The location of a pixel to be sensed directly may be rotated in a predetermined order so that all of the pixels in a block is directly sensed with elapse of time. Because device characteristics of other pixels are estimated using the sensed value, a direct sensing cycle of the pixel can be longer than conventional schemes.

Subsequently, the degree of degradation in each pixel is estimated based on the collected sensing values of the selected pixels and performs S7 data compensation using the estimated degradation of each pixel.

Figure 7:
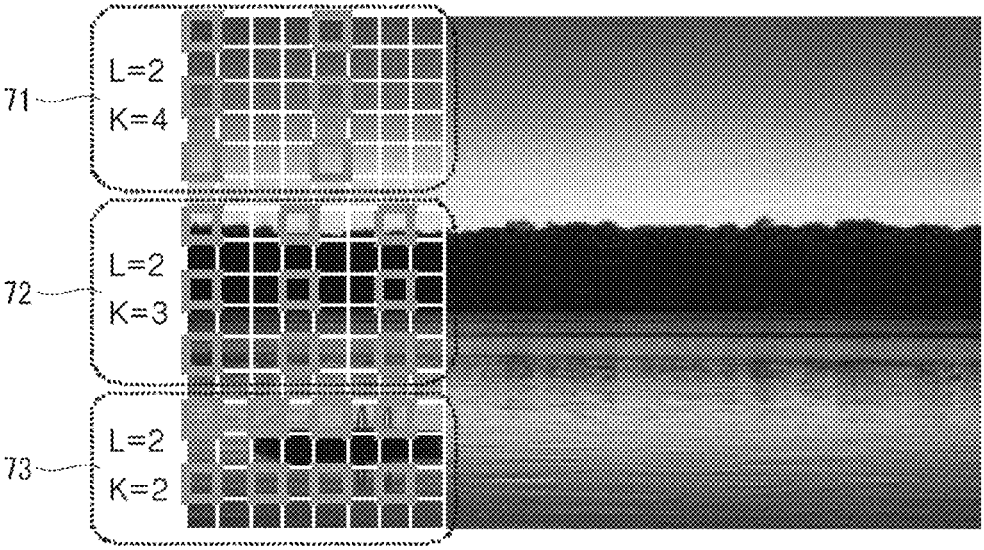
FIG. 7 shows an image of a frame divided into multiple blocks, according to one embodiment.

FIG. 7 shows an image of a frame divided into multiple blocks 71, 72 and 73, according to one embodiment. The image analyzer 112 divides an image of one frame into a plurality of blocks 71, 72, 73. A first block 71 includes pixel data representing a sky, a second block 72 includes pixel data representing water and wood, and a third block 73 includes pixel data representing a boat floating on the water.

Because the pixel data of the first block 71 represents the monotonous sky represented at similar gray levels, the pixel data of the first block 71 is similar. Hence, when pixel data of an image shown in FIG. 7 is written on pixels of the first block 71, the degree of degradation in the pixels of the first block 71 is also similar. Therefore, the sensing interval in the first block 71 is increased. In particular, because there is a small change in the pixel data of the first block 71 in the horizontal direction and there is a relatively small change in the pixel data of the first block 71 in the vertical direction, the sensing interval K is increased (in the example, K=4), and the sensing interval L is relatively decreased (in the example, L=2).

Because an image of the second block 72 is a boundary portion between the sky and the wood, there is a small change in pixel data of the second block 72 in the horizontal direction and a change in pixel data of the second block 72 in the vertical direction is larger than the first block 71. Thus, the sensing interval K of the second block 72 is increased (in the example, K=3), and the sensing interval L of the second block 72 is relatively decreased (in the example, L=2).

In an image of the third block 73, pixel data having a large gray level difference across both the horizontal direction and the vertical direction. Thus, the sensing intervals K and L of the third block 73 are both decreased (in the example, K=2 and L=2).

Figure 8:
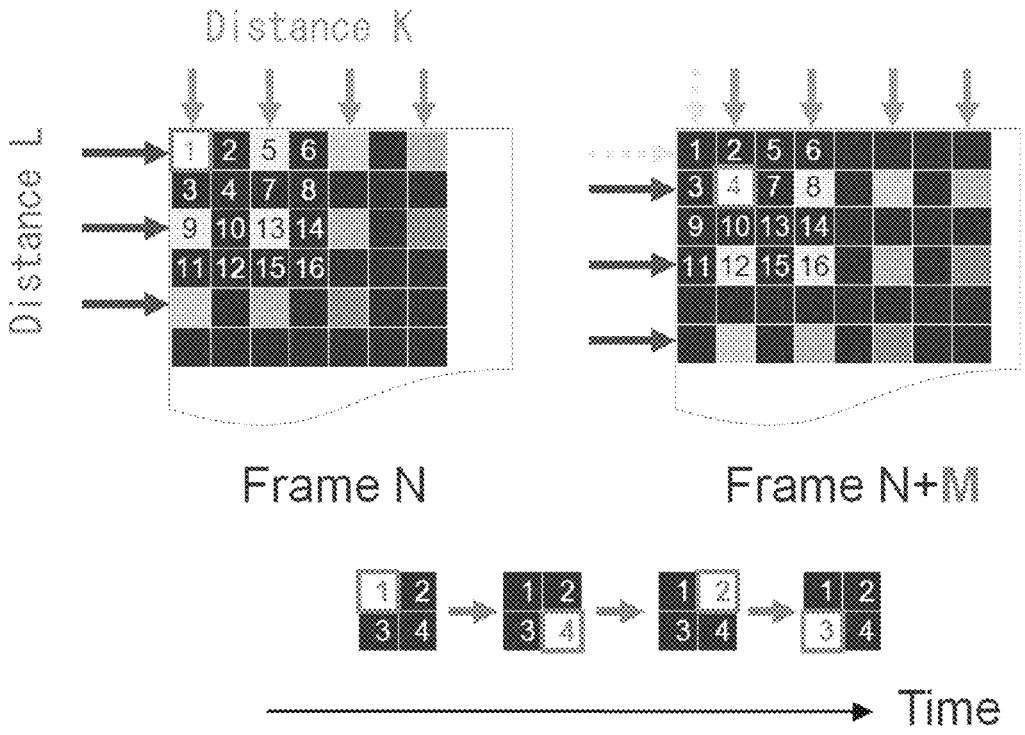
FIG. 8 is a diagram showing rotation of pixels for detecting the degree of degradation in the pixels, according to one embodiment.

FIG. 8 is a diagram showing rotation of pixels for detecting the degree of degradation in the pixels, according to one embodiment. In this example, the sensing intervals K, L, and M based on the result of an image analysis.

The embodiment of the invention may set the sensing intervals K and L to "2" in an Nth frame period and may directly sense device characteristics of first, fifth, ninth, and thirteenth pixels. The embodiment of the invention calculates device characteristics of unselected pixels using a sensing value in the Nth frame period. Device characteristics of the unselected pixels (for example, second, third, and fourth pixels) in the Nth frame period may be estimated through a known interpolation method using the sensing values of the selected first, fifth, ninth, and thirteenth pixels. For example, the device characteristics of the fourth pixel may be calculated through the interpolation method using two or more of the sensing values of the first, fifth, ninth, and thirteenth pixels.

The embodiment of the invention senses the device characteristics of the fourth pixel at an (N+M)th frame, where M is a positive integer. The location of the selected pixel may be changed at a predetermined time interval or change as a result of an analysis of the input image.

Because changes in device characteristics of pixels in a motion picture are irregular and rapid, it is preferable, but not required, to decrease a sensing cycle of the device characteristic. On the other hand, in a still image, a sensing cycle of the device characteristics of the pixel is increased for the opposite reason. Thus, the sensing interval M in an input image (for example, motion picture) expected to experience a large change in the device characteristics across time is decreased while the sensing interval M in an input image (for example, still image) expected to experience a small change in the device characteristics across the time.

Figure 9:
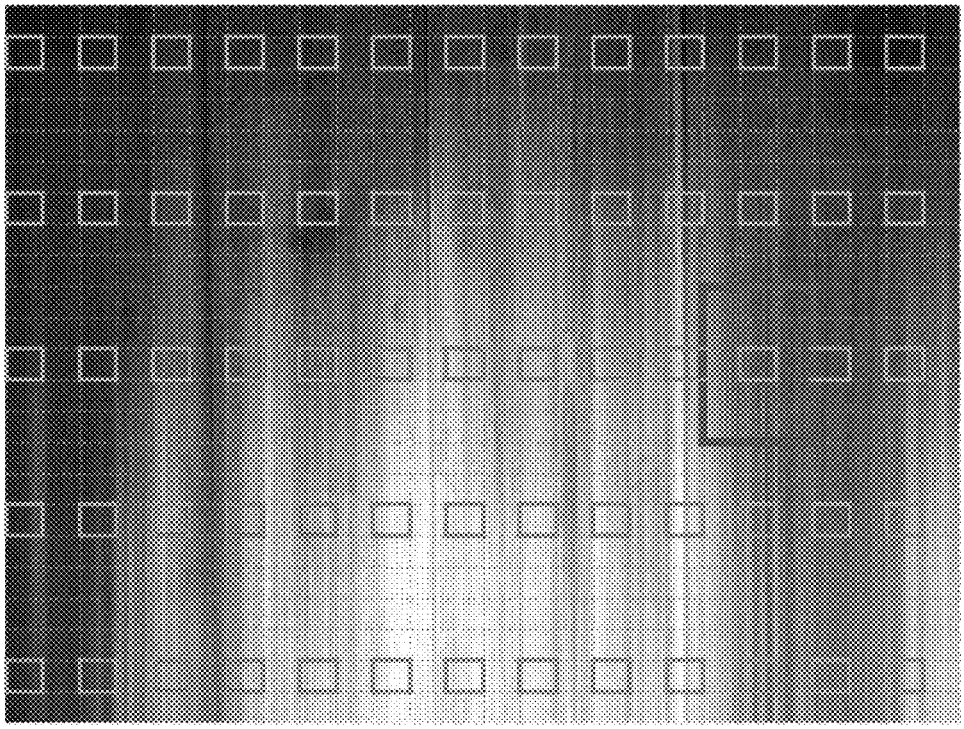
FIG. 9 is an example of an image having device characteristics change more significantly in a horizontal direction than in a vertical direction.

FIG. 9 shows an example of an image, in which there is a small change in device characteristics in the vertical direction and there is a large change in device characteristics in the horizontal direction. The highlighted boxes in FIG. 9 indicate the pixels selected for direct sensing.

In an image shown in FIG. 9, there is a small change in gray level in the vertical direction, and there is a relatively large change in gray level in the horizontal direction. In other words, degradation degrees of adjacent pixels in the vertical direction are similar to one another, and degradation degrees of adjacent pixels in the horizontal direction are different from one another. Because of this, even though the sensing interval L of the vertical direction increases, a sensing error is rarely generated between the pixels arranged along the vertical direction. On the other hand, when the sensing interval K of the horizontal direction increases, a sensing error between the pixels arranged along the horizontal direction may increase because there is a large change in the device characteristics of the adjacent pixels in the horizontal direction. Thus, embodiments of the invention select the sensing interval L of the vertical direction as a value greater than the sensing interval K of the horizontal direction. For example, in FIG. 9, the sensing intervals L and K are 5 and 2, respectively.

Figure 10:
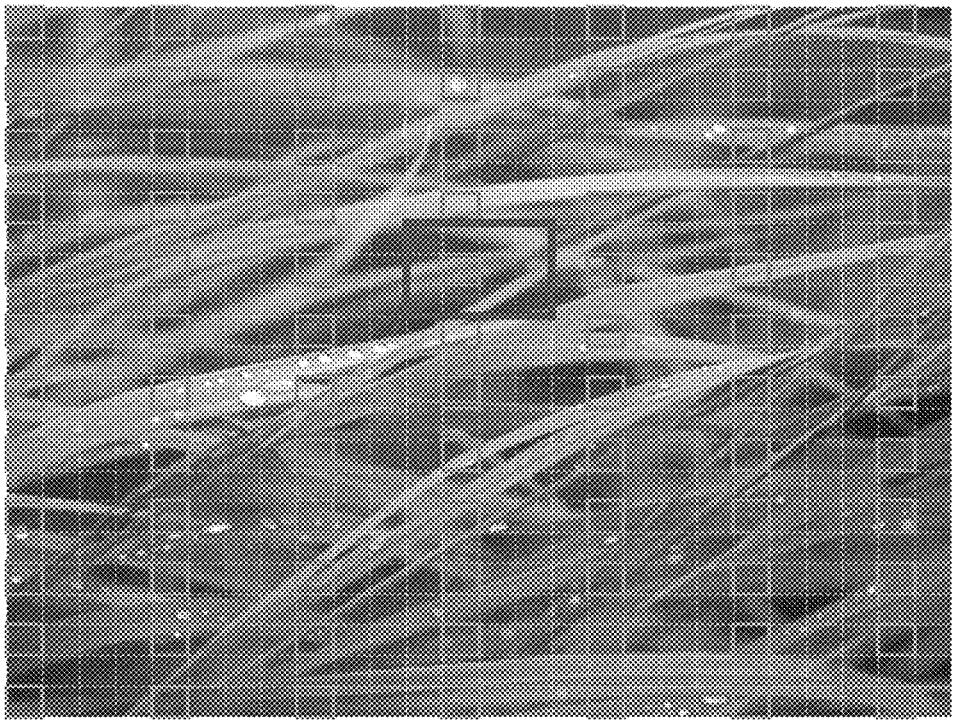
FIG. 10 shows an example of an image with a small degree of change in the horizontal direction and a large degree of change in the vertical direction and where highlighted boxes indicate the pixels selected for direct sensing, according to one embodiment.

FIG. 10 shows an example of an image with a small degree of change in device characteristics in the horizontal direction and a large degree of change in device characteristics in the vertical direction and where highlighted boxes indicate the pixels selected for direct sensing, according to one embodiment. Specifically, in the image of FIG. 10, there is a small change in gray level in the horizontal direction, while and there is a relatively large change in gray level in the vertical direction. In other words, degradation degrees of adjacent pixels in the horizontal direction are similar to one another, and degradation degrees of adjacent pixels in the vertical direction are different from one another. Because of this, even though the sensing interval K of the horizontal direction increases, a sensing error is rarely generated between the pixels arranged along the horizontal direction. On the other hand, when the sensing interval L of the vertical direction increases, a sensing error between the pixels arranged along the vertical direction may increase because there is a large change in the device characteristics of the adjacent pixels in the vertical direction. Thus, embodiments of the invention select the sensing interval K of the horizontal direction as a value greater than the sensing interval L of the vertical direction. For example, in FIG. 10, the sensing intervals L and K are 2 and 4, respectively.

Figure 11:
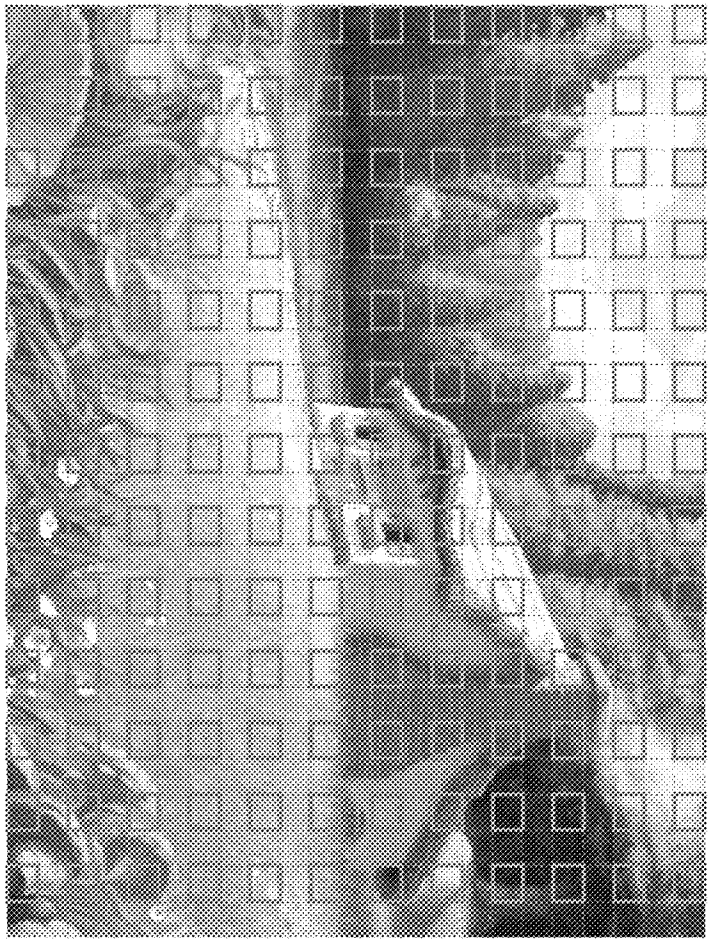
FIG. 11 shows an example of an image with complexity in the horizontal direction similar to complexity in the vertical direction and where highlighted boxes indicate the pixels selected for direct sensing, according to one embodiment.

FIG. 11 shows an example of an image with complexity in the horizontal direction similar to complexity in the vertical direction and where highlighted boxes indicate the pixels selected for direct sensing, according to one embodiment. In FIG. 11, the degree of changes in gray level in the horizontal direction is similar to the degree of changes in gray level in the vertical direction. Hence, the same value of 2 is selected for both sensing interval K in the horizontal direction and the sensing interval L in the vertical direction.

Figure 12:
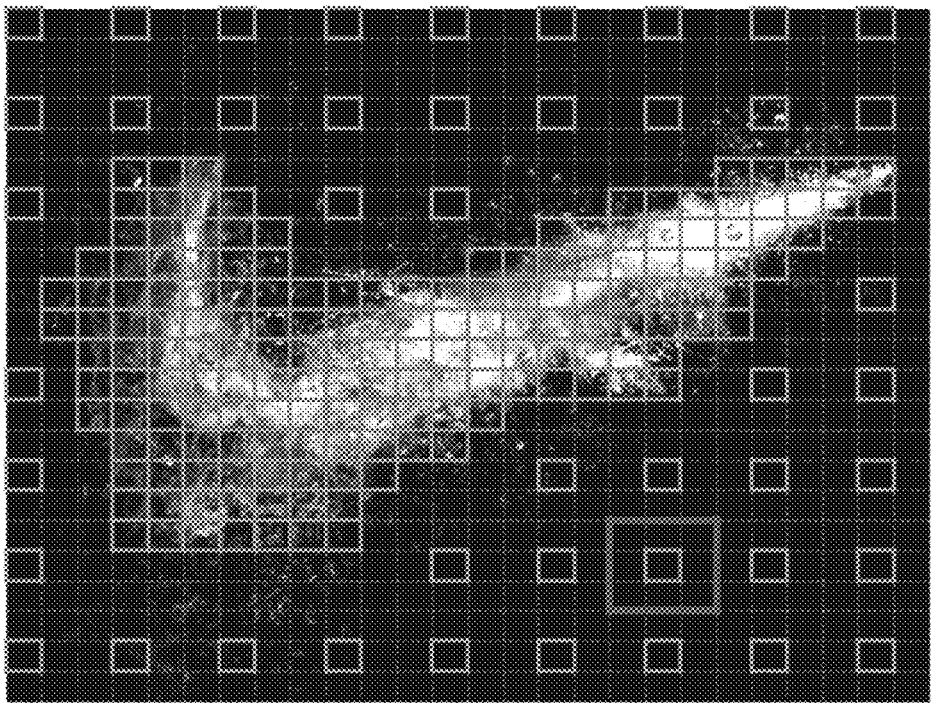
FIG. 12 shows an example of an irregular image where highlighted boxes indicate the pixels selected for direct sensing, according to one embodiment.

FIG. 12 shows an example of an irregular image where highlighted boxes indicate the pixels selected for direct sensing, according to one embodiment. In an image shown in FIG. 12, there is a large difference between a gray level of a middle portion and a gray level of a background. Further, there is a large difference between complexity of the middle portion of the image and complexity of the background. In the image with a high complexity, there is a large difference between degradation degrees of adjacent pixels. On the contrary, in a monotonous image having a low complexity, degradation degrees of adjacent pixels are similar. In the image shown in FIG. 12, the sensing interval in the middle portion is selected to be small while the sensing interval in the background is selected to be long.

The embodiment of the invention drives only the pixels of the sensing location and can greatly reduce the power consumption of the data driver 102 and the gate driver 104. The timing controller 110 may control the data driver 102 and the gate driver 104, so that only the pixels of the sensing location can be driven based on information on the sensing location received from the image analyzer 112. For example, the timing controller 110 may control the data driver 102, so that only source output channels connected to the pixels of the sensing location through the data line among source output channels of the data driver 102 are driven, and remaining source output channels are not driven. The non-driven source output channels may be floated. Because the ADC, the buffer, etc. are not driven in the non-driven source output channels, the power consumption is scarcely generated. The timing controller 110 may control the gate driver 104, so that only gate output channels connected to the pixels of the sensing location through the gate line among gate output channels of the gate driver 104 are driven, and remaining gate output channels are not driven. The non-driven gate output channels may be floated. The power consumption is scarcely generated in the non-driven gate output channels.

Embodiments of the invention select the pixels to be sensed based on the analysis of the input image and directly senses device characteristics of the selected pixels in a sensing period. The embodiment of the invention estimates changes in device characteristics of other pixels using two or more sensing values and projected degradation degrees of the other pixels. Thus, the embodiment of the invention directly sense some pixels of the input image and calculates changes in device characteristics of remaining pixels using the sensing values. Therefore, time, the memory, etc. required to sense the pixels may be improved.

When the gray levels of pixel data for the pixels are similar, the pixels are similarly degraded. On the other hands, when pixel data have a large discrepancy and/or the large gray level difference, the degradation of pixels differ significantly. Embodiments determine the sensing interval between the pixels to be sensed depending on the input image and thereby reduces the number of pixels to be directly sensed without sacrificing the sensing error.

As described above, the embodiment of the invention senses changes in the device characteristics of some pixels of the input image and calculates changes in device characteristics of other pixels using the sensing values. The embodiment of the invention changes the sensing interval based on the analysis of the input image. Thus, the embodiment of the invention can reduce time and resources (e.g., memory capacity) for sensing changes in the device characteristics of the pixels of the OLED display. Furthermore, only the channels of the driving circuit connected to the pixels selected for direct sensing are driven during a sensing period and thereby reduces the power consumption of the OLED display.

Although embodiments have been described with reference to a number of illustrative embodiments thereof, it should be understood that numerous other modifications and embodiments can be devised by those skilled in the art that will fall within the scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A method of sensing device characteristics of pixels, comprising:

analyzing an input image to at least determine gray level difference in a first direction at different portions of the input image, the different portions including a first portion with a first level of gray level difference in the first direction and a second portion with a second level of gray level difference in the first direction, the second level of gray level difference higher than the first level of gray level difference;

selecting a subset of pixels in a display panel based on the analysis of the input image, wherein the selected subset of pixels displaying the first portion is separated in the first direction by a first sensing interval, wherein the selected subset of pixels displaying the second portion is separated in the first direction by a second sensing interval shorter than the first sensing interval;

sensing the device characteristics of the selected subset of pixels in a first sensing period; and estimating the device characteristics of unselected pixels based on the sensed device characteristics of the selected subset of pixels.

2. The method of claim 1, wherein analyzing the input image further determines gray level difference in a second direction perpendicular to the first direction, wherein the different portions further include a third portion with a third level of gray level difference in the second direction and a fourth portion with a fourth level of gray level difference in the second direction, wherein the fourth level of gray level difference is higher than the third level of gray level difference, and wherein the selected subset of pixels displaying the third portion is separated in the second direction by a third sensing interval, and the selected subset of pixels displaying the fourth portion is separated in the second direction by a fourth sensing interval shorter than the third sensing interval.

3. The method of claim 1, further comprising:

selecting another subset of pixels in the display panel different from the subset of pixels in a second sensing period subsequent to the first sensing period;

sensing the device characteristics of the another selected subset of pixels in the second sensing period; and estimating the device characteristics of pixels other than the another selected subset of pixels in the second sensing period.

4. The method of claim 3, wherein a first temporal interval between the first sensing period and the second sensing period for the input image that is stationary is longer than a second temporal interval between the first sending period and the second sensing period for the input image that is dynamic.

5. The method of claim 3, wherein the another subset of pixels of the first portion selected in the second sensing period includes pixels displaying the first portion but different from the pixels selected in the first sensing period.

6. The method of claim 1, further comprising dividing the input image into the different portions, wherein each of the portions is of a same size.

7. The method of claim 1, wherein the device characteristics include at least one of a threshold voltage of a thin film transistor (TFT) for driving an organic light emitting diode (OLED) in a pixel or mobility of the TFT for driving the OLED in the pixel.

8. The method of claim 1, wherein estimating the device characteristics comprises:

performing interpolation on the selected subset of pixels in the first portion to estimate the device characteristics of unselected pixels in the first portion; and performing interpolation on the selected subset of pixels in the second portion to estimate the device characteristics of unselected pixels in the second portion.

9. The method of claim 1, further comprising storing the sensed device characteristics of the pixels and the estimated device characteristics of the pixels to perform data compensation to account for degradation of the pixels.

10. The method of claim 1, wherein the first sensing interval is selected based on the first level of gray level difference in the first direction and the second sensing interval is selected based on the second level of gray level difference in the first direction.

11. A display panel driving circuit in a display device, comprising:

an image analyzer comprising:

a processor, and a non-transitory computer-readable storage medium storing instructions thereon, the instructions when executed by a processor cause the processor to:

analyze an input image to at least determine gray level difference in a first direction at different portions of the input image, the different portions including a first portion with a first level of gray level difference in the first direction and a second portion with a second level of gray level difference in the first direction, the second level of gray level difference higher than the first level of gray level difference, and select a subset of pixels in a display panel based on the analysis of the input image, wherein the selected subset of pixels displaying the first portion is separated in the first direction by a first sensing interval, wherein the selected subset of pixels displaying the second portion is separated in the first direction by a second sensing interval shorter than the first sensing interval; and a data driver circuit configured to:

sense the device characteristics of the selected subset of pixels in a first sensing period; and estimate the device characteristics of unselected pixels based on the sensed device characteristics of the selected subset of pixels.

12. The display panel driving circuit of claim 11, wherein the computer-readable storage medium is further configured to determine gray level difference in a second direction perpendicular to the first direction, wherein the different portions further include a third portion with a third level of gray level difference in the second direction and a fourth portion with a fourth level of gray level difference in the second direction, wherein the fourth level of gray level difference is higher than the third level of gray level difference, and wherein the selected subset of pixels displaying the third portion is separated in the second direction by a third sensing interval, and the selected subset of pixels displaying the fourth portion is separated in the second direction by a fourth sensing interval shorter than the third sensing interval.

13. The display panel driving circuit of claim 11, wherein:

the computer-readable storage medium further stores instructions causing the processor to select another subset of pixels in the display panel different from the subset of pixels in a second sensing period subsequent to the first sensing period; and the data driver circuit is further configured to:

sense the device characteristics of the another selected subset of pixels in the second sensing period; and estimate the device characteristics of pixels other than the another selected subset of pixels in the second sensing period.

14. The display panel driving circuit of claim 13, wherein a first temporal interval between the first sensing period and the second sensing period for the input image that is stationary is longer than a second temporal interval between the first sending period and the second sensing period for the input image that is dynamic.

15. The display panel driving circuit of claim 13, wherein the another subset of pixels of the first portion selected in the second sensing period includes pixels displaying the first portion but different from the pixels selected in the first sensing period.

16. The display panel driving circuit of claim 11, wherein the computer-readable storage medium further stores instructions causing the processor to divide the input image into the different portions, wherein each of the portion is of a same size.

17. The display panel driving circuit of claim 11, wherein the device characteristics include at least one of a threshold voltage of a thin film transistor (TFT) for driving an organic light emitting diode (OLED) in a pixel or mobility of the TFT for driving the OLED in the pixel.

18. The display panel driving circuit of claim 11, wherein the data driver circuit is configured to estimate the device characteristics of the pixels by at least:

performing interpolation on the selected subset of pixels in the first portion to estimate the device characteristics of unselected pixels in the first portion; and performing interpolation on the selected subset of pixels in the second portion to estimate the device characteristics of unselected pixels in the second portion.

19. The display panel driving circuit of claim 11, wherein the data driver circuit is further configured to store the sensed device characteristics of the pixels and the estimated device characteristics of the pixels to perform data compensation to account for degradation of the pixels.

20. A display device comprising:

a display panel including a plurality of pixels with organic light emitting diodes (OLEDs);

an image analyzer comprising:

a processor, and a computer-readable storage medium storing instructions thereon, the instructions when executed by a processor cause the processor to:

analyze an input image to at least determine gray level difference in a direction at different portions of the input image, the different portions including a first portion with a first level of gray level difference in the first direction and a second portion with a second level of gray level difference in the direction, the second level of gray level difference higher than the first level of gray level difference, and select a subset of pixels in a display panel based on the analysis of the input image, wherein the selected subset of pixels displaying the first portion is separated in the first direction by a first sensing interval, wherein the selected subset of pixels displaying the second portion is separated in the first direction by a second sensing interval shorter than the first sensing interval; and a data driver circuit configured to:

sense the device characteristics of the selected subset of pixels in a sensing period; and estimate the device characteristics of unselected pixels based on the sensed device characteristics of the selected subset of pixels.

21. A non-transitory computer-readable storage medium storing instructions thereon, the instructions when executed by a processor cause the processor to:

analyze an input image to at least determine gray level difference in a direction at different portions of the input image, the different portions including a first portion with a first level of gray level difference in the direction and a second portion with a second level of gray level difference in the direction, the second level of gray level difference higher than the first level of gray level difference, and select a subset of pixels in a display panel based on the analysis of the input image, wherein the selected subset of pixels displaying the first portion is separated in the first direction by a first sensing interval, wherein the selected subset of pixels displaying the second portion is separated in the first direction by a second interval shorter than the first interval, wherein device characteristics of the selected subset of pixels are sensed in a sensing period but device characteristics of unselected pixels are estimated based on the sensed device characteristics of the selected subset of pixels.

* * * * *